US006821914B2

(12) United States Patent
Mizumura et al.

(10) Patent No.: US 6,821,914 B2
(45) Date of Patent: Nov. 23, 2004

(54) POLYESTER FIBER HAVING DEFORMED CROSS SECTION AND YARN AND FABRIC COMPRISING THE SAME

(75) Inventors: Tomoo Mizumura, Matsuyama (JP); Chiaki Tashiro, Matsuyama (JP); Ichiro Kitano, Ibaraki (JP); Nobuyoshi Miyasaka, Ibaraki (JP)

(73) Assignee: Teijin Limited, Osaka (JP)

( * ) Notice: Subject to any disclaimer, the term of this patent is extended or adjusted under 35 U.S.C. 154(b) by 144 days.

(21) Appl. No.: 10/009,896

(22) PCT Filed: Mar. 6, 2001

(86) PCT No.: PCT/JP01/01742

§ 371 (c)(1),
(2), (4) Date: Dec. 14, 2001

(87) PCT Pub. No.: WO01/81662

PCT Pub. Date: Nov. 1, 2001

(65) Prior Publication Data

US 2002/0187698 A1 Dec. 12, 2002

(30) Foreign Application Priority Data

Sep. 7, 1999 (JP) ..... 11-252913
Apr. 25, 2000 (JP) ..... 2000-124041
Apr. 27, 2000 (JP) ..... 2000-127308

(51) Int. Cl.[7] ..... D02G 3/00

(52) U.S. Cl. ..... 442/192; 442/193; 442/195; 442/309; 442/335; 442/336; 442/337; 428/397

(58) Field of Search ..... 428/397; 442/192, 442/193, 195, 309, 335, 336, 337

(56) References Cited

U.S. PATENT DOCUMENTS 2,816,349 A * 12/1957 Pramm et al. ..... 57/200

FOREIGN PATENT DOCUMENTS

| | | |
|---|---|---|
| JP | 60-167923 | 8/1985 |
| JP | 62-21827 | 1/1987 |
| JP | 63-196708 | 8/1988 |
| WO | WO 99/39029 A1 | 8/1999 |

OTHER PUBLICATIONS

International Search Report.

* cited by examiner

*Primary Examiner*—Elizabeth M. Cole
(74) *Attorney, Agent, or Firm*—Sughrue Mion, PLLC

(57) ABSTRACT

Irregular cross-sectional filaments made from a polyester and yarns and fabrics comprising the filaments, the cross-sectional profile of which filaments has a triangular part (A) and a flat projection part (B) connected to an angular portion of the triangular part and extending therefrom in a flat form, and satisfies the requirements (1) and (2):

$$0.7 \leq (L1/L2) \leq 3.0 \quad (1)$$

and $$3.0 \leq (h2/h1) \leq 10.0 \quad (2)$$

in which L1 represents a distance between a middle point of a connection line drawn between two intersecting points of a contour line of the part (A) with a contour line of the part (B), and a projection end point of the part (B); L2 represents a distance between a middle point of the connection line between the part (A) and the part (B), and a middle point of a side line of the part (A) facing the connection line; h1 represents a length of the connection line; and h2 represents a largest width of the part (A) in the direction at right angles to the longitudinal direction of the part (B).

18 Claims, 3 Drawing Sheets

POLYESTER FIBER HAVING DEFORMED CROSS SECTION AND YARN AND FABRIC COMPRISING THE SAME

TECHNICAL FIELD OF THE INVENTION

The present invention relates to irregular or modified cross-sectional polyester filaments and a yarn and a fabric containing the same. More particularly, the present invention relates to irregular or modified cross-sectional polyester filaments having excellent gloss and bulkiness, a pleasant touch and a high softness, and a yarn and a fabric containing the polyester filaments and having a pleasant silky touch, a high bulkiness and a high softness.

BACKGROUND ART

Various means for forming a cross-sectional profile of synthetic filaments, particularly polyester filaments, into an irregular form to impart a desired hand to the filaments are known up to now. For example, it is known that a triangular cross-sectional profile can be imparted to polyester filaments to make the gloss and hand of the resultant polyester filaments close to those of silk filaments; that a multi-lobal cross-sectional profile can be imparted to synthetic filaments to increase the dry touch of the filaments; and that the cross-sectional profile of synthetic filaments can be formed in the form of a mushroom to enhance the silk-like dry touch and a silk-like creaky (scrooping) touch.

Also, it is known that a combined filament yarn can be produced from synthetic filaments having an irregular cross-sectional profile and another synthetic filaments different in shrinking property from the above-mentioned irregular cross-sectional filaments, and the resultant shrinking property-different filaments-combined yarn is used to produce a silk-like fabric having high bulkiness and softness (soft touch). However, almost all of the conventional polyester filaments having the above-mentioned silk-like hand have a hand close to that of non-wild silk filaments and polyester filaments having a hand close to that of wild silk filaments, particularly those classified into Tussah silk filaments, are rare. Particularly, the conventional silk-like synthetic filaments are definitely different in natural creaky (frictional) touch from the wild silk filaments. Also, the conventional silk-like synthetic filaments are unsatisfactory in bulkiness, softness and light weight in comparison with natural silk filaments.

Japanese Unexamined Patent Publication No. 56-20,638 discloses polyester filament yarns capable of forming a fabric having silk-like surface touch and creaky (frictional) hand. The silk-like polyester filament yarns are produced by melt-spinning a polyester composition containing an organic sulfonate salt through a plurality of spinning openings having a circular cross-sectional profile; drawing the resultant undrawn filament yarn and applying an alkali weight-reduction treatment to the drawn filaments yarn, each filament having a circular cross-sectional profile. In the silk-like polyester filament yarn, the individual filaments have a plurality of fine pores arranged along the longitudinal axes of the filaments. It is known, however, when the conventional technology is applied to the polyester filament yarn in which the individual filaments have an irregular cross-sectional profile, for example, a triangular cross-sectional profile, the resultant irregular cross-sectional polyester filament yarn are unsatisfactory in the tussah silk-like natural creaky hand, bulkiness, softness, and light weight.

On the other hand, it is known that drawn thick and thin type filaments can be obtained by drawing undrawn synthetic filaments, at a draw ratio lower than the natural draw ratio of the polyester filaments, to cause an unevenness in thickness of the resultant drawn filaments to be generated.

The surface of a fabric formed from the thick and thin type filament yarns exhibit a rough touch and an uneven appearance due to the uneven thickness of the filaments. However, when conventional synthetic filaments having a triangular or trilobal or multi-lobal cross-sectional profile are formed in a thick and thin type filament form, the resultant thick and thin type irregular cross-sectional synthetic filaments do not exhibit tussah silk-like natural creaky touch, bulkiness, softness and light weight.

Accordingly, development of polyester filaments, yarns and fabrics having tussah silk-like natural creaky touch, bulkiness, softness and light weight is strongly demanded.

SUMMARY OF THE INVENTION

An object of the present invention is to provide polyester irregular cross-sectional filaments and a yarn and a fabric containing the same, having excellent wild silk-like natural creaky touch, gloss, bulkiness, softness and light weight.

The polyester irregular cross-sectional filaments of the present invention comprises individual filaments comprising a polyester and having a transverse cross-sectional profile which has:

(A) a triangular part having a triangular form; and (B) a flat projection part connected to an angular portion of the triangular part and extending therefrom in a flat form, and which cross-sectional profile satisfies the requirements (1) and (2) shown below:

$$0.7 \leqq (L1/L2) \leqq 3.0 \quad (1)$$

and $$3.0 \leqq (h2/h1) \leqq 10.0 \quad (2)$$

in which requirement (1),

L1 represents a distance between a middle point of a connection line drawn between two intersecting points of a contour line of the triangular part (A) with a contour line of the flat projection part (B), and a projection end point of the flat projection part (B); and represents a distance between a middle point of the connection line between the triangular part (A) and the flat projection part (B), and a middle point of an side line of the triangular part (A) facing the connection line; and in which requirement (2), h1 represents a length of the connection line between the triangular part (A) and the flat projection part (B); and h2 represents a largest width of the triangular part (A) in the direction at right angles to the longitudinal direction of the flat projection part (B).

In the polyester irregular cross-sectional filaments of the present invention, the cross-sectional profile of the individual filaments preferably further satisfies the requirement (3) shown below:

$$2.0 < (L1/h1) \quad (3)$$

In the polyester irregular cross-sectional filaments of the present invention, the triangular part (A) may have a hollow portion extending in the longitudinal direction of the filament.

In the polyester irregular cross-sectional filaments of the present invention, preferably, the polyester from which the filaments are formed is blended with an organic sulfonate metal salt represented by the general formula (I):

$$R\ SO_3\ Mn \quad (I)$$

in which formula (I), R represents a member selected from alkyl group having 3 to 30 carbon atoms, and aryl and alkylaryl groups having 7 to 40 carbon atoms; M represents a member selected from alkali metal atoms and alkaline earth metal atoms, and n represents an integer of 1 when M represents a monovalent metal atom or a number of ½ when M represents a divalent metal atom. In the polyester irregular cross sectional filaments of the present invention, each individual filament may comprise high thickness portions and low thickness portion alternately formed in the longitudinal direction of the filament, and the high thickness portions are preferably distributed in the number of 20/m or more.

The polyester filament yarn of the present invention comprises the polyester irregular cross-sectional filaments of the present invention as defined above.

In the polyester filament yarn of the present invention, preferably each of the polyester irregular cross-sectional filaments comprises high thickness portions and low thickness portions formed alternately in the longitudinal direction of each filament, and in the polyester filament yarn containing the thick and thin type filaments, the high thickness portions are distributed in the number of 20/m or more in the longitudinal direction of the yarn.

The combined polyester filament yarn of the present invention comprises a filament component having a lowest shrinkage in boiling water and consisting of the polyester irregular cross-sectional filaments of the present invention as defined above, and a filament component having a high shrinkage in boiling water and consisting of at least one type of polyester filaments having a higher shrinkage in boiling water than that of the polyester irregular cross-sectional filaments.

In the combined polyester filament yarn of the present invention, preferably, a difference in boiling water shrinkage between the polyester irregular cross-sectional filaments for the filament component having the lowest boiling water shrinkage, and the polyester filaments contained in the high boiling water shrinkage filament component and having a highest boiling water shrinkage, is 4 to 40%.

In the combined polyester filament yarn of the present invention, the polyester contained in the highest boiling water shrinkage polyester filaments is preferably a polyethylene trephthalate isophthalate and the content of isophtalic acid in the dicarboxylic acid component of the polyester is preferably 5 to 15 molar %.

In the combined polyester filament yarn of the present invention, preferably, the highest boiling water shrinkage polyester filaments are thick and thin filaments having large thickness portions and small thickness portions alternately distributed in the longitudinal direction of the filaments, and in the combined polyester filament yarn containing the thick and thin filaments mentioned above, the large thickness portions are distributed in the number of 20/m or more in the longitudinal direction of the yarn.

The polyester filament fabric of the present invention comprises at least one type of polyester filament yarn of the present invention as defined above, and the combined polyester filament yarn of the present invention as defined above, and has a silk-like hand.

In the polyester filament fabric of the present invention, the fabric is a woven fabric, the yarn is a twisted yarn having a twist multiplier of 2500 or more, and the twisted yarn are contained as warp yarns in the woven fabric.

BEST EMBODIMENT FOR CARRYING OUT THE INVENTION

Figure 1:
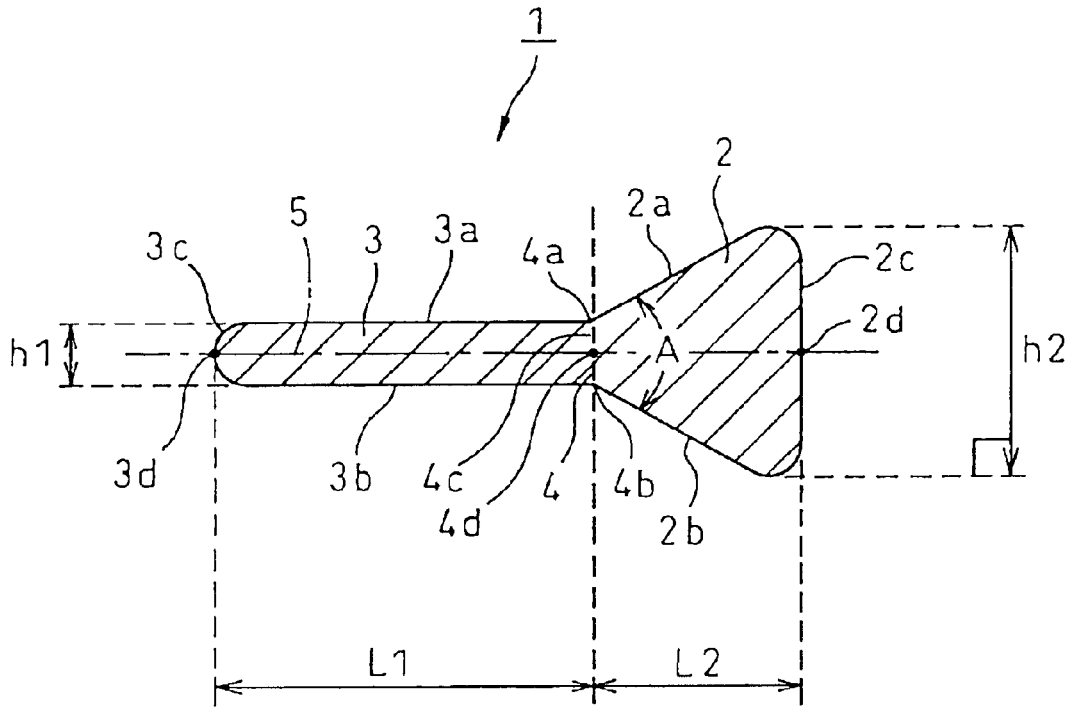
FIG. 1 is an explanatory cross-sectional view of an embodiment of the polyester irregular cross-sectional filaments of the present invention.

The polymer component for forming the polyester filaments of the present invention having an irregular cross-sectional profile preferably comprises a polyester having, as main repeating units, ethylene terephthalate units, trimethylene terephthalate units or tetramethylene terephthalate units, for example, a polyethylene terephthalate, or a copolyester, for example, a polyethylene terephthalate isophthalate, having as other repeating units in addition to the ethylene terephthalate units, for example, ethylene isophthalate units. The other repeating units are preferably contained in an amount of 15 molar % or less, more preferably 10 molar % or less, still more preferably 5 molar % or less, based on the total molar amount of the repeating units.

The polyester filaments of the present invention may optionally contain an additive comprising, for example, delusterant, for example, titanium dioxide, zinc oxide, etc., ultraviolet ray-absorver, thermal stabilizer and coloring agent. Particularly, in the polyester filaments of the present invention, an organic sulfonate metal salt represented by the formula (I) shown below:

$$R\ SO_3\ Mn \qquad (I)$$

in which formula (I), R represents a member selected from alkyl groups having 3 to 30 carbon atoms and aryl and alkylaryl groups having 7 to 40 carbon atoms, M represents a member selected from alkali metals and alkaline earth metals, n represents an integer of 1 when M represents a monovalent metal atom or the number ½ when M represents a divalent metal atom, is preferably blended in a content of 0.5 to 2.5% by weight, more preferably 0.8 to 1.2% by weight, based on the weight of the polyester component.

In the polyester filaments containing the above-mentioned organic sulfonate metal salt, a plurality of fine pores formed in the surface portions of the filaments and arranged along the filament axis direction can be formed by applying a weight reduction treatment with an alkali to the filaments. The fine pores formed in the surface portions of the polyester filaments contribute to imparting preferable tussah silk-like dry touch and creaky hand to the alkali weight reduction-treated polyester filaments, and thus the yarns or fabrics made of the filaments exhibit preferable tussah silk-like hand and appearance (gloss). In the organic sulfonate metal salt represented by the chemical formula (I), when R represents an alkyl or alkylaryl group, the alkyl group thereof may be in the form of a straight chain or of a branched chain having side chain parts. Particularly, to enhance the compatibility with the polyester, the organic sulfonate metal salts of the formula (I) preferably a metal salt of an alkyl-sulfonic acid having an alkyl group R as defined above: M is selected from alkali metals, for example, sodium, potassium and lithium and alkaline earth metals, for example, calcium and magnesium, and is preferably sodium or potassium. The organic sulfonate metal salts of the general formula (I) usable for the present invention are preferably selected from alkali metal salts of $C_8$–$C_{18}$ alkylsulfonic acids, for example, sodium stearylsulfonate, sodium octylsulfonate and sodium laurylsulfonate.

The cross-sectional profile of the polyester irregular cross-sectional filaments of the present invention will be explained by referring to FIG. 1.

In FIG. 1, the cross-sectional profile 1 of a polyester-containing individual filament has (A) a triangular part 2 having a triangular form and (B) a flat projection part 3 connected to an angular portion of the triangular part 2 and extending therefrom in a flat form. In this cross-sectional profile, a contour of the triangular part 2 and a contour of the flat projection part 3 intersect each other and are connected to each other at intersecting points 4*a* and 4*b* of the two side lines 2*a* and 2*b* of the triangular part 2 extending toward the connection portion 4 and facing each other with the two side lines 3*a* and 3*b* of the flat projection part 3 facing each other. In the connection line drawn between the intersecting points 4*a* and 4*b*, the triangular part 2 and the flat projection part 3 are connected to each other. A middle point of the connection line 4*c* (4*a*–4*b*) is referred to as 4*d*.

The triangular part 2 has an opposite side 2*c* facing the connection line 4*c*. A middle point of the opposite side 2*c* is referred to as 2*d*. The projection end side 3*c* of the flate projection part 3 has a projection end point 3*d*. In FIG. 1, the triangular part 2 is in an approximate equilateral (regular) triangle form having three sides 2*a*, 2*b* and 2*c* having same length as each other. Thus, upper and lower portions of the cross-sectional profile shown in FIG. 1 are symmetrical with respect to a straight line 5 drawn through the middle point 3*d* of the projection end side of the flat projection part 3 and the middle point 4*d* of the connection line 4*c*.

Figure 2:
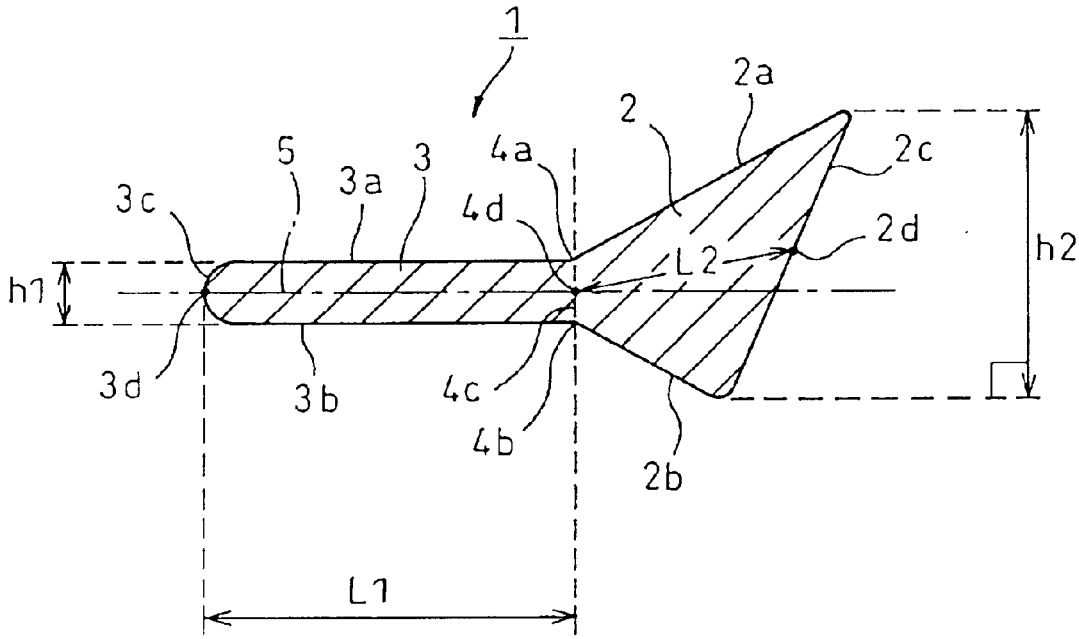
FIG. 2 is an explanatory cross-sectional view of another embodiment of the polyester irregular cross-sectional filaments of the present invention.
Figure 3:
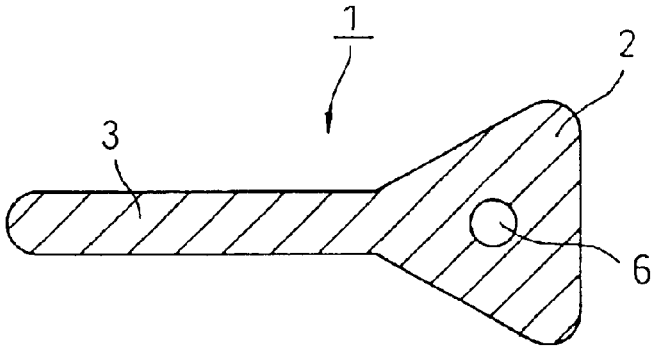
FIG. 3 is an explanatory cross-sectional view of still another embodiment of the polyester irregular cross-sectional filaments of the present invention.

In FIG. 2, another cross-sectional profile of the polyester irregular cross-sectional filaments of the present invention is shown. In this profile of FIG. 2, the triangular part 2 is in the form of an non-equilateral triangle formed from three sides 2*a*, 2*b* and 2*c* which are different in length from each other.

The upper and lower portions of this cross-sectional profile are asymmetrical with respect to the straight line 5 drawn through the middle point 3*d* of the projection end side 3*c* of the flate projection part 3 and the middle point 4*d* of the connection line 4*c*.

The irregular cross-sectional profiles of the polyester filaments of the present invention shown, for example, in FIGS. 1 and 2, satisfy the following requirements (1) and (2):

$$0.7 \leqq (L1/L2) \leqq 3.0 \quad (1)$$

and $$3.0 \leqq (h2/h1) \leqq 10.0 \quad (2)$$

In the requirement (1), L1 represents a distance between a middle point 4*d* of the connection line 4*c* between the triangular part 2 and the flat projection part 3 and a projection end point 3*d* of the flat projection part 3, and represents a distance between the middle point 4*d* of the connection line 4*c* and a middle point 2*d* of the side 2*c* of the triangular part 2 facing the connection line 4*c*.

In the requirement (2), h1 represents a length of the connection line 4*c* (4*a*–4*b*) between the triangular part 2 and the flat projection part 3, and h2 represents a largest width of the triangular part 2 in the direction at right angles to the longitudinal direction of the flat projection part 3.

If the cross-sectional profile of the polyester filaments composed of the above-mentioned triangular part and flat projection part is different from that mentioned above, for example, the flat projection part extends from a side of the triangular part(, namely the contour of the flat projection part intersect only one side of the triangular part), the stability of a melt-spinning procedure for the filaments is low. Also, if two or more of flat protection parts extend from two or more angular portions of the triangular part, the resultant irregular cross-sectional polyester filaments exhibit a hand different from that of the wild silk filaments. Further, if the projection part has a form different from the flat form (for example, has a circular form), the resultant irregular cross-sectional polyester filaments and yarns and fabrics produced therefrom exhibit an undesirable hand insufficient in creaky touch.

The above-mentioned requirement (1) defines a relationship between L1 which is a projection length of the flat projection part (B) from the connection line 4*c* and which is a projection length of the triangular part (A) from the connection line 4*c*, and when the ratio L1/L2 is in the range of from 0.7 to 3.0, the resultant irregular cross-sectional polyester filaments and the yarns and fabrics produced therefrom exhibit well balanced performance in creaky touch, softness and bulkiness thereof. If the value of the ratio L1/L2 is less than 0.7, the resultant irregular cross-sectional polyester filaments and the yarns and fabrics containing the same exhibit an unsatisfactory balance between the creaky touch and the softness thereof. Also, if the value of the ratio L1/L2 is more than 3.0, the melt-spinning procedure for producing the irregular cross-sectional polyester filaments exhibit an insufficient stability, and the resultant filaments, yarns and fabrics exhibit an unsatisfactory bulkiness. The value of the ratio L1/L2 is preferably in the range of from 1.5 to 2.5.

The above-mentioned requirement (2) defines a ratio of the width of the flat projection part (B) to the width of the triangular part (A), and the ratio is important to cause the resultant irregular cross-sectional polyester filaments and the yarns and fabrics containing the same to obtain a good balance of the creaky touch with the softness and the bulkiness thereof. If the ratio h2/h1 is less than 3.0, the resultant irregular cross-sectional polyester filaments and the yarns and the fabrics containing the same exhibit an unsatisfactory bulkiness. If the ratio is more than 10.0, the melt-spinning procedure for producing the irregular cross-sectional polyester filaments exhibits an insufficient stability and the resultant filaments have uneven quality. The ratio h2/h1 is preferably in the range of from 4.0 to 7.0.

In the irregular cross-sectional polyester filaments of the present invention, the cross-sectional profile thereof preferably further satisfy, in addition to the requirements (1) and (2), the requirement (3) shown below.

$$2.0 \leqq (L1/h1) \quad (3)$$

Also, the value of the ratio L1/h1 is preferably 2.0 to 20, more preferably 5.0 to 10. When the ratio L1/h1 is less than 2.0, the cross-sectional profile of the projection part may not be in a flat form, and the resultant irregular cross-sectional polyester filaments and the yarns and the fabrics containing the filaments may be unsatisfactory in wild silk-like creaky touch and softness.

In FIG. 1, the direction of the projection of the flat projection part 3 (the direction of the straight line 3*c*–4*c*) is preferably in the angle defined between the extensions (not shown in FIG. 1) of the two sides 2*a* and 2*b* of the triangular part 2 connected to the flat projection part 3, particularly the direction is more preferably on a bisector line by which a vertical angle defined by the two sides 2*a* and 2*b* of the triangular part is divided into two equal parts. Namely, the above-mentioned bisector is preferably on an extension of the straight line 3*d*–4*d*.

In the cross-sectional profile of the flat projection part 3, the two sides 3*a* and 3*b* facing each other are preferably in parallel to each other. However, the cross-sectional profile of the flat projection part 3 may be in various modified forms, as long as the modified forms are recognized as a flat form. For example, the cross-sectional profile of the flat projection part 3 may be in a gently waved flat form. In this case, an amplitude of a center line of the flat projection part preferably 0.3 times or less the length h1 of the connection line 4*c*. Alternatively, there may have slight change in the width of the flat projection part 3. In this case, a ratio of the largest width of the third portions to the smallest width of the thin portions of the flat projection part 3 is preferably 1.5/1 or less. Otherwise, at least one of the two sides 3*a* and 3*b* facing each other may have small convexities. In this case, the height of the small convexities is preferably 0.2 times or less the length of the connection line 4*c* (4*a*–4*b*). Still otherwise, the width of the flat projection part is gradually decreased with an increase in distance from the connection line 4*d* toward the projection end face 3*c*. In this case, the incline angle of each of the two sides 3*a* and 3*b* of the flat projection part 3 facing each other from the straight line 3*d*–4*d* is preferably 15 degrees or less.

In the cross-sectional profile of the irregular cross-sectional polyester filaments of the present invention, referring to FIG. 1, the cross-sectional profile of the triangular part 2 may include various modified triangular forms as long as they can be recognized as a triangular form. The triangular forms include equilateral triangle, isosceles triangle (2*a*=2*b*) and non-equilateral triangle forms, and the sides 2*a*, 2*b* and 2*c* may be straight lines or curved lines curving inward or expanding outward. Also, the two vertex portions of the triangular part other than the vertex portion connected to the flat projection part may be rounded as shown in FIG. 1.

When the form of the triangular part 2 is replaced by another form, for example, a circular, tetragonal, or hexagonal form, the resultant irregular cross-sectional polyester filaments and the yarns and fabrics containing the filaments exhibit unsatisfactory creaky touch.

The irregular cross-sectional polyester filaments of the present invention may be in a hollow filament form of which the cross-sectional profile has, as shown in FIG. 2, a hollow 6 formed in the triangular part 2. The hollow 6 extends in the longitudinal direction (along the filament axis). The hollow 6 contributes to enhancing the bulkiness and the light weight of the irregular cross-sectional polyester filaments. In this cross-sectional profile, the cross-sectional area of the hollow 6 is preferably 15% or less, more preferably 3 to 10%, based on the total cross-sectional area of the triangular part 2. If the cross-sectional area of the hollow is too large, in the production of the polyester filaments, and the stability of the melt-spinning procedure, may be insufficient.

The irregular cross-sectional polyester filaments of the present invention can be produced by, for example, the following process. In this process, a resin containing a polyester as a principal component is melted at a temperature of 280 to 300° C., the melt is extruded through melt spinning orifices of a spinneret, the resultant filamentary melt streams are cooled and solidified while being taken-up, an oiling agent is applied to the resultant filaments, to provide undrawn filaments, and the undrawn filaments are optionally interlaced by an interlace-applying apparatus, and wound up around a winder through a pair of taking-up rollers at room temperature, then the undrawn filaments are preheated by a preheating roller heated to a temperature of 80 to 110° C., fed to a non-contact type heater set up at a temperature of 170 to 220° C. and drawn at a drawing speed of 60 to 1400 m/min. at a draw ratio of 1.5 to 3.0, while heating the filaments to the above-mentioned temperature, and the drawn filaments are optionally subjected to an interlacing treatment and are then wound up.

Figure 4:
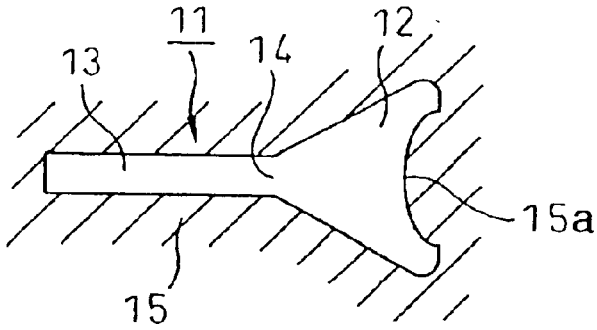
FIG. 4 is a cross-sectional view of an embodiment of a spinning opening of a spinneret usable for the production of the polyester irregular cross-sectional filaments of the present invention.
Figure 5:
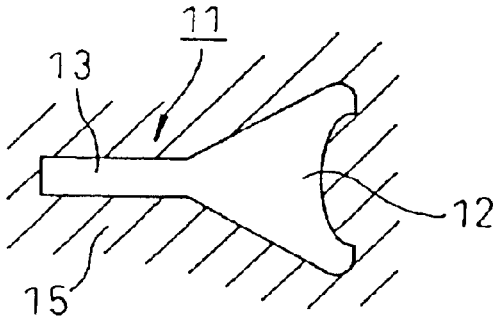
FIG. 5 is an explanatory cross-sectional view of another embodiment of a spinning opening of a spinneret usable for the production of the polyester irregular cross-sectional filaments of the present invention.
Figure 6:
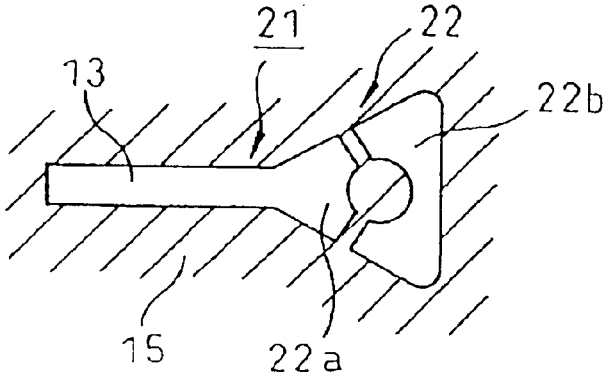
FIG. 6 is an explanatory cross-sectional view of still another embodiment of a spinning opening of a spinneret usable for the production of the polyester irregular cross-sectional filaments of the present invention.

The melt-spinning orifices of the spinneret usable for the production of the irregular cross-sectional polyester filaments of the present invention have the opening forms, for example, as shown in FIGS. 4 to 6.

In FIG. 4, a spinning opening 11 formed in a spinneret 15 has a form in which a flat projection-formed opening part 13 and a triangle-formed opening part 12 are connected to each other at a connection portion 14, a side 15*a* of the triangle-formed opening part facing the connection portion 14 is curved in an inwardly curved form. When extruded through the spinning opening as mentioned above, the resultant curved faces of the filamentary polyester melt streams are made to a substantially flattened faces immediate after the extrusion by a surface tension of the melt streams.

The spinning opening 11 shown in FIG. 5 is similar to that in FIG. 4, except that the flat projection-formed opening part of FIG. 5 has a length shorter than that in FIG. 4.

The spinning opening 21 shown in FIG. 6 is used for producing an irregular cross-sectional hollow-filament. In the opening 21, a hollow triangle-formed opening part 22 is divided into two parts, namely a vertical portion 22*a* and an opposite side portion 22*b* of the triangle-formed opening part, and two filamentary polyester melt streams extruded through the divided two opening portions 22*a* and 22*b* are connected to each other immediate after the streams passed through the opening portions, to form an irregular cross-sectional hollow filamentary polyester stream.

There is no specific limitation to the thickness of the individual irregular cross-sectional polyester filaments of the present invention. Preferably, the filaments have an individual filament thickness of 1.5 to 4.5 d tex and are produced as a filament yarn (filament bundle) having a total thickness of 55 to 170 d tex.

The irregular cross-sectional polyester filaments of the present invention include thick and thin filaments having high thickness portions and low thickness portions formed alternately with each other in the longitudinal direction (along the filament axis) of each filament.

To produce the thick and thin filaments, the undrawn filaments are subjected to a conventional drawing procedure at a draw ratio below the natural draw ratio of the filaments. For this purpose, a process in which a undrawn filament bundle having been wound up is drawn while being contacted intermittently with a frictional resistant material, and another process in which undrawn filaments are subjected to a fluid-agitation treatment, as a pre-treatment, such as an interlacing treatment or TASLAN treatment, to make the drawing property of the undrawn filaments uneven, and then are drawn, can be utilized. In the above-mentioned drawing procedure, since positions of drawing points on the individual undrawn filaments in the filament bundles are unevenly distributed, in the resultant drawn filament bundle, the high thickness portions and low thickness portions of each individual filament contained in the bundle are unevenly distributed, and thus the high thickness portions and low thickness portions are distributed at random in the bundle of the filaments along the longitudinal direction. Therefore, in the drawn filament bundle, the overlapping of high thickness portions or the low thickness portions of the individual filaments on each other can be prevented.

In the yarn containing the irregular cross-sectional polyester filaments of the present invention, the distribution density of the high thickness portions in the longitudinal direction of the yarn is preferably 20/m or more, more preferably 20/m to 40/m, still more preferably 20/n to 30/m.

On the yarns containing the above-mentioned irregular cross-sectional polyester thick and thin filaments and on the fabrics made by using the yarns, a silk-like rough surface feel (convexity and concavity feel) can be recognized by hand touch on the yarn surface and the fabric surface.

When the distribution density of the high thickness portions distributed in the yarn is less than 20/m, the distribution density of the high thickness portions and the low thickness portions in the yarn are too low, and therefor the resultant yarn exhibits uneven appearance and hand and thus the quality of the yarn is evaluated low. Also, in the resultant fabric from the above-mentioned yarn, the high thickness portions of the filaments located at the surface portion of the fabric causes a feeling of disorder and thus the resultant fabric exhibit a touch significantly different from the natural silk-like touch.

In the present invention, the distribution density of the high thickness portions in a yarn comprising irregular cross-sectional polyester thick and thin type filaments is determined by the following measurement.

A sample of the yarn is subjected to a yarn evenness test using an evenness tester (made by KEISOKUKI KOGYO K.K.) at a yarn speed of 8 m/min. at a chart speed of 0.05 m/min, under condition in the range of Normal ±50%, to measure the evenness of the yarn sample, and from the measurement result, the number of peaks corresponding to thickness of 10% or more higher than the average thickness of the yarn, per m of the yarn, is determined. The determined number of peaks represents the distribution density of the high thickness portions per m of the yarn.

The high thickness portions of the filaments are portions drawn at a low draw ratio, and thus exhibit a low mechanical strength. Thus, in the thick and thin type filament yarn, it is preferred that the high thickness portions of the individual filaments are not locally distributed in the yarn. When the distribution density of the high thickness portions in the thick and thin type filament yarn is more than 40/m, the distribution density of the high thickness portions is too high, and the mechanical strength of the yarn may be insufficient and thus the filament breakages and the yarn breakages during the production and processing of the yarn may increase.

The irregular cross-sectional polyester filaments (including thick and thin type filaments) of the present invention may be used to form a yarn only therefrom, or may be combined with another type of filaments to form a combined yarn.

Other filaments usable for the combined polyester filament yarns of the present invention may be filaments comprising polymers different in chemical type, or polyester or other polymer filaments different in cross-sectional profile and/or thickness, or polyester or other polymer filaments different in properties (for example, chemical, mechanical, thermal and/or electric property, for example, shrinkage in boiling water), from the filaments of the present invention.

The combined polyester filament yarn of the present invention is characterized by comprising a filament component having a lowest shrinkage in boiling water and consisting of the irregular cross-sectional polyester filaments of the present invention and another filament component having high shrinkage in boiling water and consisting of at least one type of polyester filaments having a higher shrinkage in boiling water than that of the irregular cross-sectional polyester filaments.

The polyester filaments usable for the filament compound having a high shrinkage in boiling water may comprise the same polymer as that for the polyester filaments having the lowest shrinkage in boiling water (the irregular cross-sectional polyester filaments of the present invention) and different only in the shrinkage in boiling water. Preferably, the polyester filaments having the high shrinkage in boiling water are selected from copolyester filaments, to provide the filament component having a high shrinkage in boiling water. The above-mentioned copolyester are selected from those in which a portion of ethylene glycol component and/or terephthalic acid component for forming the polyethylene terephthalate is replaced by isophthalic acid, bisphenol A or an aromatic dicarboxylic acid having a sulfonate metal salt group, for example, 5-sodium sulfoisophthalic acid, 5-potassium sulfoisophthalic acid, 5-lithium sulfoisophthalic acid, 4-sodium sulfoisophthalic acid, or 4-sodium sulfo-2,6-naphthalene dicarboxylic acid. Preferably, polyethylene terephthalate isophthalates are used. In polyethylene terephthalate isophthalates, the content of isophthalic acid in the dicarboxylic acid component is preferably 5 to 15 molar %, more preferably 8 to 12 molar %. The above-mentioned type of polyethylene terephthalate isophthalates fibers has good mechanical properties, for example, good tensile strength and ultimate elongation, and exhibit a sufficient shrinkage in boiling water.

When the high shrinkage filaments and the lowest shrinkage filaments are formed from the same type of polyester as each other, in the production of these filaments, the spinning draft, drawing and/or heat treatment for the two types of filaments may be carried out under conditions different from each other.

There is no limitation to the cross-sectional profile of the high shrinkage filaments usable for the combined yarn of the present invention, and other than the lowest shrinkage filaments. The cross-sectional profile of the high shrinkage filaments may be selected from circular, triangular, and cross-form cross-sectional profiles. When the high shrinkage filaments have an irregular cross-sectional profile similar to that of lowest shrinkage irregular cross-sectional filaments the resultant combined yarn and fabric made from the yarn exhibit an enhanced bulkiness, softness, light weight and creaky touch.

The high shrinkage filaments preferably have an individual filament thickness similar to that of the lowest shrinkage filaments, namely, in the range of from 1.5 to 4.5 d tex, to enhance the compatibility thereof with the lowest shrinkage filaments. Also, the filaments having a high shrinkage in boiling water preferably have a shrinkage in boiling water in the range of from 15.0 to 40.0%.

When the combined filament yarn is composed of only two types of filaments, the mixing weight ratio of the lowest shrinkage filament component to the high shrinkage filament component is preferably in the range of from 2:8 to 8:2, more preferably from 3:7 to 7:3.

When the content of the lowest shrinkage filament component is too high, the enhancing effect thereof on the bulkiness, softness and light weight may be insufficient, and when the content is two low, the improvement effect of the lowest shrinkage filaments on the hand, such as creaky touch may by insufficient.

To produce the combined filament yarn of the present invention, the above-mentioned lowest shrinkage filament component and high shrinkage filament component are combined by a conventional method, and the resultant combined filament yarn is subjected to an interminglement treatment. For example, the two filament components are separately from each other wound up, these filament components are paralleled to each other, the paralleled yarn is optionally further drawn, and is subjected to a filament-combining and interminglying treatment. Alternatively, in a spinning procedure, two types of filaments components extruded together through a spinneret or separately through two sinneret are subjected to a filament-combining and intermingling treatment, and then the combined and intermingled filament yarn is optionally drawn.

In the above-mentioned procedures, the number of interminglements of the filaments contained in the combined filament yarn is preferably controlled to 30 to 80 interminglements per m of the yarn.

If the interminglements per m of the filaments are too few, the resultant yarn may exhibit a low bundling property and an insufficient handling quality. Also, if the interminglements per m are too frequent, the resultant combined filament yarn may be unsatisfactory in bulkiness, softness and weight and may exhibit a spun-yarn-like appearance.

When a fabric produced from the combined filament yarn of the present invention is treated by a boiling water treatment or a high temperature hot water treatment or a high temperature dry heating treatment in dyeing and finishing procedures, the high shrinkage filament portions of the yarn is shrunk so as to constitute mainly a core portion of the fabric, and to cause the lowest shrinkage filament portions of the yarn to be mainly distributed in the surface portion of the fabric, and thus, as a whole, the fabric exhibits a high bulkiness, an appropriate softness and a good weight. Also, the lowest shrinkage irregular cross-sectional filaments mainly distributed in the surface portions of the fabric impart desirable silk-like creaky touch and gloss to the fabric.

In the combined filament yarn of the present invention, a difference in shrinkage in boiling water between the irregular cross-sectional polyester filaments for the filament component having the lowest shrinkage in boiling water and the polyester filaments contained in the filament component having a highest shrinkage in boiling water is preferably 4 to 40%, more preferably 6 to 35%. If the difference is less than 4%, the resultant combined filament yarn and fabric produced therefrom may exhibit insufficient bulkiness, silk-like creaky touch and gloss. Also, if the difference is more than 40%, the resultant combined filament yarn may exhibit, after a treatment with boiling water or a heat shrinking treatment is applied, too high a bulkiness and a unsatisfactory handling property, and the boiling water-treated or heat-treated combined filament fabric may exhibit too stiff a hand.

In the combined polyester filament yarn of the present invention, the irregular cross-sectional polyester filaments having a lowest shrinkage in boiling water may be thick and thin type filaments having large thickness portions and small thickness portions alternately distributed in the longitudinal direction thereof. In the high thickness portion-containing combined filament yarn, the high thickness portions are preferably distributed in the number of 20/m or more, more preferably 20 to 40/m, still more preferably 20 to 30/m along the longitudinal direction of the yarn. By using the above-mentioned irregular cross-sectional polyester thick and thin type filaments as the filament component having a lowest shrinkage in boiling water, the silk-like hand of the resultant combined polyester filament yarn and fabrics formed therefrom can be significantly enhanced.

The polyester filament yarn and/or combined polyester filament yarn containing the irregular cross-sectional polyester filaments (which may be thick and thin type filaments) of the present invention can be used to produce a fabric having silk-like hand and appearance. In the process for producing the fabric, for example, the polyester filament yarn or the combined filament yarn are optionally subjected to a twisting procedure, and the yarn is used to produce a woven or knitted fabric having a desired structure. Optionally, the fabric is treated by a weight reduction treatment with alkali. In this case, the resultant fabric can exhibit excellent silk-like creaky touch, bulkiness, softness and a light weight, which could not be obtained on the conventional polyester filament fabric.

In the polyester filament fabric of the present invention, particularly to enhance the silk-like creaky touch and light weight, the fabric preferably has a simple weaving or knitting structure selected from, for example, plain weave structures and modifications thereof, simple twill structures and modifications thereof, satin structures and modifications thereof, tubular knitting structures (T-cloth (plain knitting) structure, circular interlock knitting structure, rib knitting structure, KANOKO tucking knitting structure, Ponti soma knitting structure, Mock rody knitting structure and Cross-miss knitting structure), and warp knitting structures (Denbigh stitch structure, half tricot stitch structure, satin stitch structure, and Atlas stitch structure). There is no limitation to weight of the fabric. Preferably, the fabric has a light weight of 300 g/m$^2$ or less.

When the silk-like polyester fabric of the present invention is a woven fabric, the yarns for the fabric preferably have a twist multiplier of 2,500 or more, more preferably 3,000 to 10,000. When the yarn having the above-mentioned twist multiplier is used, in the resultant fabric, even when the densities of the warps and wefts in the weaving structure are low, the slippages of the yarns in relation to each other can be prevented, and, in the dyeing procedure for the fabric, the passing property of the dyeing liquid through the fabric is good, and thus, generation of defects due to a poor passing property of the dyeing liquid through the fabric can be prevented.

There is no limitation to the content of the irregular cross-sectional polyester filaments in the irregular cross-sectional polyester filament yarn and/or the combined filament yarn of the present invention, as long as the resultant fabric exhibits desired performances, hand and appearance (gloss). Preferably, the irregular cross-sectional polyester filament yarn and/or combined filament yarn having the above-mentioned twist multiplier is used as at least warp yarn for the fabric. Of course, the silk-like hand, performance and appearance of the fabric are improved with increase in the content of the irregular cross-sectional polyester filaments in the polyester fabric of the present invention.

The twist multiplier of the twisted yarn can be calculated in accordance with the following equation.

$$\text{Twist multiplier} = \text{Twist number (turns/m)} \times (9/10 \times \text{yarn thickness (d tex)})^{1/2}$$

EXAMPLES

The irregular cross-sectional polyester filaments and yarns and fabrics containing the filaments of the present invention will be further explained by the following examples.

Example 1

A polyethylene terephthalate resin containing 0.6% by weight of a sodium alkylsulfonate having the number of carbon atoms in the range of from 8 to 20 and an average number of carbon atoms of 14, and having an intrinsic viscosity of 0.61 determined in an orthochlorophenol solution at 35° C., was melt-extruded through a spinneret having the spinning openings as shown in FIG. 4, the extruded filamentary streams were cooled to solidify them, the resultant filaments were oiled, subjected to an interlacing procedure, and then taken up and wound up at a speed of 1400 m/min. The resultant undrawn filament yarn was drawn at a preheating roller temperature of 87° C., at a heat-setting heater (non-touch type) temperature of 200° C. at a draw ratio of 2.3 at a drawing speed of 800 m/min., and then, to the drawn filament yarn, an interlacing treatment was applied to produce an irregular cross-sectional filament yarns having a yarn count of 83.3 d tex (75 denier)/24 filaments. The cross-sectional characteristics of the resultant filaments are shown in Table 1.

The resultant yarns were twisted with a twist multiplier of 2,000, and used as warp and weft yarns to produce a plain (HABUTAE) weave having warp density of 90 yarns/2.54 cm and a weft density of 88 yarns/2.54 cm. The resultant fabric was subjected to scouring (95° C.), heat-setting (180° C.), alkali weight reduction (95° C., weight reduction: 15%) and dyeing (navy blue color, 130° C.) treatments, to produce a solid-colored fabric. The evaluation results on the fabric are shown in Table 1.

The creaky touch, bulky touch and light weight feeling of the fabric were organoleptically evaluated by five expert panelists, into three classes, namely, "excellent", "good" and "bad".

Examples 2 and 3 and Comparative Examples 1 to 6

In each of Examples 2 and 3 and Comparative Example 1 to 6, the same procedures as in Example 1 were carried out to produce a solid dyed woven fabric, except that the characteristics of the cross-sectional profile were changed to those shown in Table 1. The evaluation results are shown in Table 1.

TABLE 1

| | Item | | | | | | |
|---|---|---|---|---|---|---|---|
| | Cross-sectional characteristics | | | | Fabric properties | | |
| Example No. | L1/L2 | h2/h1 | L1/h1 | Hollow area % | Creaky touch | Bulky touch | Light weight |
| Comparative Example | | | | | | | |
| 1 | 1.0 | 1.0 | — | 0% | Good | Bad | Bad |
| 2 | 0.5 | 5.3 | — | 5% | Good | Bad | Excellent |
| 3 | 2.0 | 2.0 | — | 5% | Good | Bad | Excellent |

TABLE 1-continued

| | Item | | | | | | |
|---|---|---|---|---|---|---|---|
| | Cross-sectional characteristics | | | | Fabric properties | | |
| Example No. | L1/L2 | h2/h1 | L1/h1 | Hollow area % | Creaky touch | Bulky touch | Light weight |
| Comparative Example Example | | | | | | | |
| 1 | 2.0 | 5.3 | — | 5% | Excellent | Excellent | Excellent |
| 2 | 0.8 | 5.3 | — | 5% | Excellent | Excellent | Excellent |
| 3 | 2.0 | 5.3 | — | 0% | Excellent | Excellent | Excellent |
| Comparative Example | | | | | | | |
| 4 | Hollow circular Cross-section | | — | 20% | Bad | Excellent | Excellent |
| 5 | Circular cross section | | — | 0% | Bad | Bad | Bad |
| 6 | Triangular cross section | | — | 0% | Good | Bad | Bad |

Examples 4 and 5

In each of Examples 4 and 5, an undrawn filament yarn was prepared by the same procedures as in Example 1, except that the extrusion rate of the polymer melt in the melt-spinning procedure was changed so that after the drawing procedure, the resultant drawn filaments had a total thickness of 83.3 d tex (75 denier). The undrawn filament yarn was drawn at a preheating roller temperature of 65° C., at a heat-setting heater (non-touch type) temperature of 165° C. at a draw ratio of 1.6 at a drawing speed of 800 m/min.; and the drawn filament yarn was subjected to an interlacing treatment, to produce a thick and thin type filament yarn having a yarn count of 83.3 d tex (75 denier)/24 filaments.

The cross-sectional characteristics and the distribution number of the high thickness portions of the resultant yarn are shown in Table 2.

The obtained yarn was twisted in the same manner as in Example 1 and was subjected to a weaving procedure to provide a plain weave (HABUTAE). The woven fabric was scoured (95° C.), heat-set (180° C.), treated with an alkali at 95° C. to reduce the weight of the fabric with a weight reduction of 15%, and dyed to a navy blue color at 130° C., to provide a solid dyed woven fabric.

The evaluation results of the fabric are shown in Table 2.

The test for the silk-like surface rough touch was organoleptically effected by five expert panelists, and the test results were classified into three classes, namely, "excellent", "good" and "bad".

TABLE 2

| | Item | | | | | | | | |
|---|---|---|---|---|---|---|---|---|---|
| | Cross-sectional characteristics | | | | The distribution | Fabric property | | | |
| Example No. | L1/L2 | h2/h1 | L1/h1 | Hollow area % | number of high thickness portions per m | Creaky touch | Bulky touch | Light weight | Rough touch |
| Example | | | | | | | | | |
| 4 | 2.0 | 5.3 | — | 5% | 25 | Excellent | Excellent | Excellent | Excellent |
| 5 | 0.8 | 5.3 | — | 25% | 25 | Excellent | Excellent | Excellent | Excellent |

Example 6

In Example 6, an undrawn filament yarn was produced by the same procedures as in Example 1, except that in the melt spinning procedure, the taking up speed of the filament yarn was changed to 1450 m/min. The undrawn filament yarn was drawn at a preheating roller temperature of 87° C. at a heat setting heater (non-touch type) temperature of 200° C. at a draw ratio of 2.2 at a drawing speed of 800 m/min. A low-shrinkage, irregular cross-sectional filament yarn having a yarn count of 90 d tex/24 filaments, a tensile strength of 2.2 cN/d tex, an ultimate elongation of 35% and a shrinkage in boiling water of 9% was obtained.

Separately, a polyethylene terephthalate isophthalate resin (intrinsic viscosity: 0.63) containing copolymerized isophthalic acid in an amount of 10 molar %, was melt-extruded through a spinneret having circular spinning openings, the extruded filamentary streams were cooled to solidify, the solidified filament yarn was oiled, subjected to an interlacing treatment, and taken up and wound up at a speed of 1400 m/min. The obtained undrawn filament yarn was drawn at a pre-heating roller temperature of 87° C., at a heat-setting heater (non-touch type) temperature of 200° C. and at a draw ratio of 2.9 at a drawing speed of 800 m/min. A high-shrinkage filament yarn having a yarn count of 55 d tex/12 filaments, a tensile strength of 40 cN/d tex, an ultimate elongation of 37% and a shrinkage in boiling water of 19%.

The above-mentioned high shrinkage filament yarn and the low shrinkage filament yarn were set parallel to each other; and interlacing treatment was applied to the filament yarns through a combining and intermingling apparatus, to provide a combined filament yarn having a yarn count of 145 d tex/36 filaments. The number of interminglements of the filaments in the combined filament yarn was 40/m.

The obtained combined filament yarn was employed as warp and weft yarns to produce a plain weave (HABUTAE). The woven fabric was scoured (95° C.), heat-set (180° C.), treated with an alkali to reduce the weight thereof (95° C., weight reduction: 15%), and dyed (130° C.) to a navy blue color, to provide a solid dyed woven fabric. The resultant dyed woven fabric exhibited excellent creaky touch and gloss and very good (excellent) bulky touch and softness.

Example 7

The same twisted irregular cross-sectional polyester filament yarn as in Example 1 and having a yarn count of 83.3 d tex (75 denier)/24 filaments and a twist multiplier of 5,000 was employed as a warp yarn, and a twisted regular polyester multifilament yarn having a yarn count of 83.3 d tex (75 denier)/36 filaments and a twist multiplier of 26,000 was employed as a weft yarn, to produce a plain weave at a warp density of 115 yarns/2.54 cm at a weft density of 89 yarns/2.54 cm. The woven fabric was scoured at 95° C., relaxed at 130° C., pre-heat set at 190° C., alkali-treated to reduce the weight thereof at 95° C. at a weight reduction of 20%, dyed at 130° C. and finally heat-set at 160° C., to produce a solid dyed fabric. The resultant fabric exhibited excellent tussah silk-like light weight and wild creaky touch. Also, it was found that, in the dyeing procedure, generation of an unevenness in dyeing due to poor passing of the dyeing liquid through the fabric was rare and no slippage of the yarns intersecting each other occurs, while the fabric had a low yarn density.

Industrial Applicability

By using the irregular cross-sectional polyester filaments of the present invention, silk-like filament yarn and fabric having a wild silk-like creaky touch which could not be obtained by using the conventional irregular cross-sectional filaments, and excellent silk-like gloss, bulkiness, softness and light weight, can be obtained. The polyester filaments, yarns and fabrics of the present invention have very high industrial applicability.

What is claimed is:

1. Polyester irregular cross-sectional filaments, comprising individual filaments each comprising a polyester and having a transverse cross-sectional profile which has:

(A) a triangular part having a triangular form; and (B) a flat projection part connected to an angular portion of the triangular part and extending therefrom in a flat form, and which cross-sectional profile of each individual filament satisfies the requirements (1) and (2) shown below:

$$0.7 \leqq (L1/L2) \leqq 3.0 \quad (1)$$

and $$3.0 \leqq (h2/h1) \leqq 10.0 \quad (2)$$

in which requirement (1),

L1 represents a distance between a middle point of a connection line drawn between two intersecting points of a contour line of the triangular part (A) with contour line of the flat projection part (B), and a projection end point of the flat projection part (B); and L2 represents a distance between a middle point of the connection line between the triangular part (A) and the flat projection part (B), and a middle point of an side line of the triangular part (A) facing the connection line; and in which requirement (2), h1 represents a length of the connection line between the triangular part (A) and the flat projection part (B); and h2 represents a largest width of the triangular part (A) in the direction at right angles to the longitudinal direction of the flat projection part (B).

2. The polyester irregular cross-sectional filaments as claimed in claim 1, wherein the cross-sectional profile of the individual filaments further satisfies the requirement (3) shown below:

$$2.0 \leqq (L1/h1) \quad (3)$$

3. The polyester irregular cross-sectional filaments as claimed in claim 1, wherein the triangular part (A) has a hollow portion extending in the longitudinal direction of the filament.

4. The polyester irregular cross-sectional filaments as claimed in claim 1, wherein the polyester from which the filaments are formed is blended with an organic sulfonate metal salt represented by the general formula (I):

$$R\ SO_3\ Mn \quad (I)$$

in which formula (I), R represents a member selected from alkyl group having 3 to 30 carbon atoms, and aryl and alkylaryl groups having 7 to 40 carbon atoms; M represents a member selected from alkali metal atoms and alkaline earth metal atoms, and n represents an integer of 1 when M represents a monovalent metal atom or a number of ½ when M represents a divalent metal atom.

5. The polyester irregular cross-sectional filaments as claimed in claim 1, wherein each individual filament has large thickness portions and small thickness portion alternately formed in the longitudinal direction of the filament.

6. The polyester filament yarn comprising the polyester irregular cross-sectional filaments as claimed in claim 1.

7. The polyester filament yarn as claimed in claim 6, wherein each polyester irregular cross-sectional filaments has large thickness portions and small thickness portions formed alternately in the longitudinal direction of the filament, and in the polyester filament yarn containing the thick and thin-type filaments, the high thickness portions are distributed at a rate of 20/m or more in the longitudinal direction of the yarn.

8. A combined polyester filament yarn comprising a filament component having a lowest shrinkage in boiling water and consisting of the polyester irregular cross-sectional filaments as claimed in claim 1, and a filament component having a high shrinkage in boiling water and consisting of at least one type of polyester filaments having a higher shrinkage in boiling water than that of the polyester irregular cross-sectional filaments.

9. The combined polyester filament yarn as claimed in claim 8, wherein a difference in shrinkage in boiling water between the polyester irregular cross-sectional filaments for the filament component having the lowest shrinkage in boiling water, and the polyester filaments contained in the filament component having a high shrinkage in boiling water and having a highest shrinkage in boiling water, is 4 to 10%.

10. The combined polyester filament yarn as claimed in claim 8, wherein the polyester contained in the polyester filaments having a highest shrinkage in boiling water is a polyethylene trephthalate isophthalate and the content of isophtalic acid in the dicarboxylic acid component of the polyester is 5 to 15 molar%.

11. The combined polyester filament yarn as claimed in claim 8, wherein the polyester filaments having a highest shrinkage in boiling water are thick and thin type filaments having high thickness portions and low thickness portions alternately distributed in the longitudinal direction of the filaments and, in the combined polyester filament yarn containing the thick and thin type filaments mentioned above, the high thickness portions are distributed at a rate of 20/m or more in the longitudinal direction of the yarn.

12. The polyester irregular cross-sectional filaments as claimed in claim 3, wherein the polyester from which the filaments are formed is blended with an organic sulfonate metal salt represented by the general formula (I):

$$RSO_3M_n \quad (I)$$

in which formula (I), R represents a member selected from alkyl group having 3 to 30 carbon atoms, and aryl and alkylaryl groups having 7 to 40 carbon atoms; M represents a member selected from alkali metal atoms and alkaline earth metal atoms, and n represents an integer of 1 when M represents a monovalent metal atom or a number of ½ when M represents a divalent metal atom.

13. A polyester filament fabric comprising at least one type of yarn selected from the polyester filament yarn as claimed in claim 6 or 7.

14. A polyester filament fabric comprising the combined polyester filament yarn as claimed in any one of claims 8 to 11.

15. The polyester filament fabric as claimed in claim 13, wherein the fabric is a woven fabric, the yarn is a twisted yarn having a twist multiplier of 2,500 or more, and the twisted yarns are contained as warp yarns in the woven fabric.

16. The polyester filament fabric as claimed in claim 14, wherein the fabric is a woven fabric, the yarn is a twisted yarn having a twist multiplier of 2,500 or more, and the twisted yarns are contained as warp yarns in the woven fabric.

17. The polyester filament fabric as claimed in claim 14, further comprising a polyester filament yarn which comprises polyester irregular cross-sectional filaments comprising individual filaments each comprising a polyester and having a transverse cross-sectional profile which has:

(A) a triangular part having a triangular form; and (B) a flat projection part connected to an angular portion of the triangular part and extending therefrom in a flat form, and which cross-sectional profile of each individual filament satisfies the requirements (1) and (2) shown below:

$$0.7 \leqq (L1/L2) \leqq 3.0 \quad (1)$$

and $$3.0 \leqq (h2/h1) \leqq 10.0 \quad (2)$$

in which requirement (1),

L1 represents a distance between a middle point of a connection line drawn between two intersecting points of a contour line of the triangular part (A) with contour line of the flat projection part (B), and a projection end point of the flat projection part (B); and L2 represents a distance between a middle point of the connection line between the triangular part (A) and the flat projection part (B), and a middle point of an side line of the triangular part (A) facing the connection line; and in which requirement (2), h1 represents a length of the connection line between the triangular part (A) and the flat projection part (B); and h2 represents a largest width of the triangular part (A) in the direction at right angles to the longitudinal direction of the flat projection part (B), and having a silk-like hand.

18. The polyester filament fabric as claimed in claim 17, wherein each polyester irregular cross-sectional filaments has large thickness portions and small thickness portions formed alternately in the longitudinal direction of the filament, and in the polyester filament yarn containing the thick and thin-type filaments, the high thickness portions are distributed at a rate of 20/m or more in the longitudinal direction of the yarn.

* * * * *

UNITED STATES PATENT AND TRADEMARK OFFICE

CERTIFICATE OF CORRECTION

PATENT NO. : 6,821,914 B1
DATED : November 23, 2004
INVENTOR(S) : Mizumura et al.

It is certified that error appears in the above-identified patent and that said Letters Patent is hereby corrected as shown below:

Title page,
Item [30], Foreign Application Priority Data, delete "Sep. 7, 1999 (JP) 11-252913".

Signed and Sealed this

Fifteenth Day of November, 2005

JON W. DUDAS
*Director of the United States Patent and Trademark Office*